United States Patent [19]

Masuda et al.

[11] Patent Number: 5,039,236

[45] Date of Patent: Aug. 13, 1991

[54] PRINT HEAD WITH TAPERED CONICAL RETURN SPRING

[75] Inventors: Katsuya Masuda; Masao Kunita; Makoto Yasunaga, all of Tanashi, Japan

[73] Assignee: Citizen Watch Co., Ltd., Tokyo, Japan

[21] Appl. No.: 497,722

[22] Filed: Mar. 15, 1990

Related U.S. Application Data

[63] Continuation of Ser. No. 192,662, May 11, 1988, abandoned.

[30] Foreign Application Priority Data

May 11, 1987 [JP] Japan ..... 62-70057
Nov. 25, 1987 [JP] Japan ..... 62-178392

[51] Int. Cl.[5] ..... B41J 2/275
[52] U.S. Cl. ..... 400/124; 101/93.34
[58] Field of Search ..... 400/124, 157.2, 157.3; 101/93.05, 93.29, 93.33, 93.34

[56] References Cited

U.S. PATENT DOCUMENTS 4,014,425 3/1977 Gijzen et al. ..... 400/124
4,016,965 4/1977 Wirth et al. ..... 400/124
4,018,155 4/1977 Cargill ..... 101/93.34
4,437,775 3/1984 Ochiai et al. ..... 400/124
4,708,501 11/1987 Takemoto ..... 101/93.29
4,728,205 3/1988 Hasumi et al. ..... 400/124
4,852,481 8/1989 Kobrya et al. ..... 101/93.29

FOREIGN PATENT DOCUMENTS 217969 4/1987 European Pat. Off. ..... 400/124
2597789 10/1987 France ..... 400/124
21868 2/1981 Japan ..... 400/124
27764 2/1982 Japan ..... 400/124
2567 1/1986 Japan ..... 400/124

*Primary Examiner*—David A. Wiecking

[57] ABSTRACT

A dot matrix print head has a print wire unit having a plurality of print wires, an armature unit having a plurality of armatures, each corresponding to the print wire, and an electromagnet unit having electromagnets. Each wire comprises a wire body and a head. A return coil spring is provided between the head of the print wire and a guide plate. The return coil spring has a small diameter end portion engaged with the head and a large diameter portion engaged with the guide plate and has a substantially conical peripheral shape. The large diameter portion engages a recess, thereby preventing rotation of the spring.

5 Claims, 2 Drawing Sheets

PRINT HEAD WITH TAPERED CONICAL RETURN SPRING

This application is a continuation of application Ser. No. 07/192,662 filed May 11, 19088, now abandoned.

BACKGROUND OF THE INVENTION

The present invention relates to a print head for a dot matrix printer in which each print needle is separated from an armature, and more particularly to a return coil spring for returning the print needle in the print head.

U.S. Pat. No. 4,647,236 discloses such a print head in which a needle return spring is provided between an impact head of the print needle and a guide member formed in a guide nose.

Generally, the impact head is manufactured by a cutting process with a lathe. The manufactured head is fixed to a needle body by brazing or spot welding or other processes. However, such a manufacturing process comprises a plurality of steps, which causes an increase of manufacturing cost.

In order to produce a print needle at low cost, a heading process (cold forging) for integrally forming the head with the needle body is proposed. However, the diameter of the impact head manufactured by the heading process inherently becomes small. In the prior art, the return spring is a coil spring having a constant diameter. Accordingly, the diameter of the coil spring becomes small with the reduction of the diameter of the impact head. However, it is difficult to assemble such a small diameter spring into a print needle. In operation, the print needle slides on the spring at the inside periphery thereof, which causes an unstable operation of the needle because of sliding resistance. Since the diameter of the spring is small, an excessive force of the spring at the compression thereof is exerted in a bottom wall of the guide member, so that the bottom is worn by the end of the spring to form a recess. As a result, returning force of the spring decreases, causing malfunctions of printing operation, such as scratching of an inked ribbon with the print needle.

SUMMARY OF THE INVENTION

The object of the present invention is to provide a print head having a print needle with a small head and a return spring which effectively and properly acts on the print needle.

To this end, the spring has a substantially conical peripheral shape, and a small diameter end of the spring is abutted against the head.

According to the present invention, there is provided a dot matrix print head having a print needle unit having a plurality of print needles, each of which comprises a needle body and a head integral with the needle body, an armature unit having a plurality of armatures, each corresponding to the print needle, an electromagnet unit having electromagnets for actuating the print needles, and a return coil spring provided between the head of the print needle and a guide plate.

The return coil spring has a small diameter end portion engaged with the head and a large diameter portion engaged with the guide plate and has a substantially conical peripheral shape.

In an aspect of the invention, a portion of the return coil spring at each end is closely wound so that two or more windings of the spring come in contact with each other. The head of the print needle is integrally formed with the needle body of the needle.

These and other objects and features of the present invention will become more apparent from the following detailed description with reference to the accompanying drawings.

DESCRIPTION OF THE PREFERRED EMBODIMENT

Figure 1:
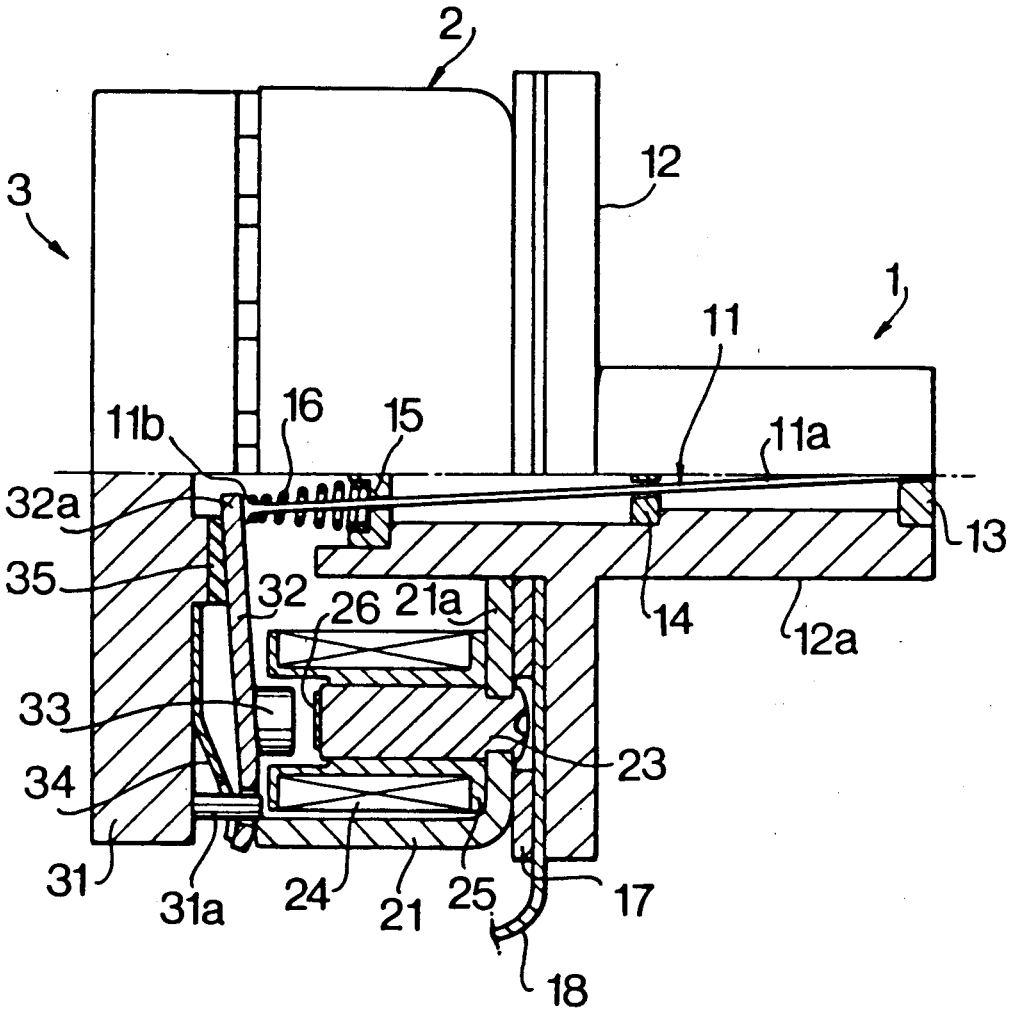
FIG. 1 is a sectional side view showing a print head for a dot matrix printer according to the present invention.

Referring to FIG. 1, a print head comprises a print needle unit 1, an electromagnet unit 2 securely mounted on the print needle unit 1, and an armature unit 3 securely mounted on the electromagnet unit 2. The units 1 and 2 are secured by clamp means (not shown), interposing an insulator 17 and a flexible printed wiring board 18.

The print needle unit 1 comprises a print needle guide body 12 having a needle guide nose 12*a* extending from the body 12. The needle guide nose 12*a* is provided with a front end guide plate 13, an intermediate guide plate 14, and a rear end guide plate 15, which are provided for slidably guiding a plurality of print needles 11. Each of the print needles 11 is slidably supported in the guide plates 13 to 15. Print needles 11 are circularly disposed in a rear portion of the print head, and arranged on the straight in the front end guide plate 13, at the front end of the nose 12*a*. Each of print needles 11 has a needle body 11*a* and an impact head 11*b* formed by a heading process with a header machine. A compression coil return spring 16 is disposed the impact head 11*b* and the rear end guide plate 15. Thus, the print needle 11 is biased to the rear portion of the print head.

Figure 2:
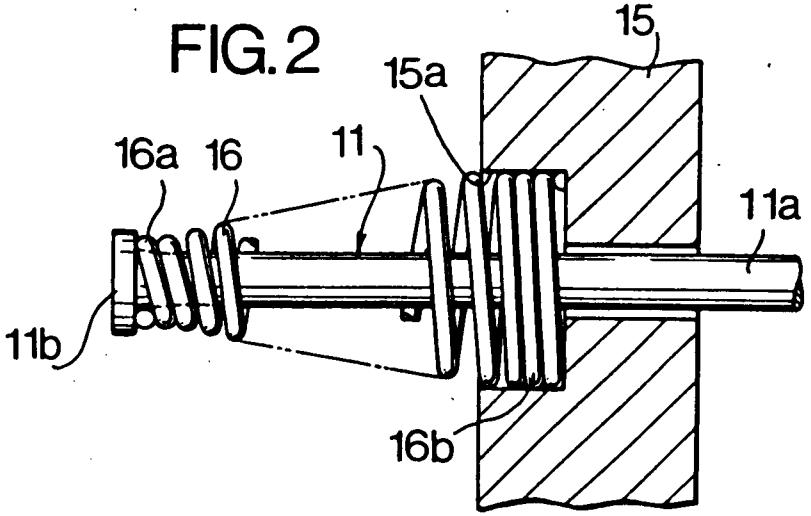
FIG. 2 is an enlarged sectional side view showing a part of a print needle unit.

As shown in FIG. 2, the return spring 16 has a small diameter end 16*a* engaged with the head 11*b* and a large diameter end 16*b* mounted on a recess 15*a* formed in the guide plate 15, and has a conical shape in peripheral shape. A portion of the wire corresponding to two or more windings at each end of the spring is closely wound so that adjacent windings come in contact with each other. Moreover, the contact portion at the large diameter end 16*b* is formed into a cylindrical shape.

Figure 3:
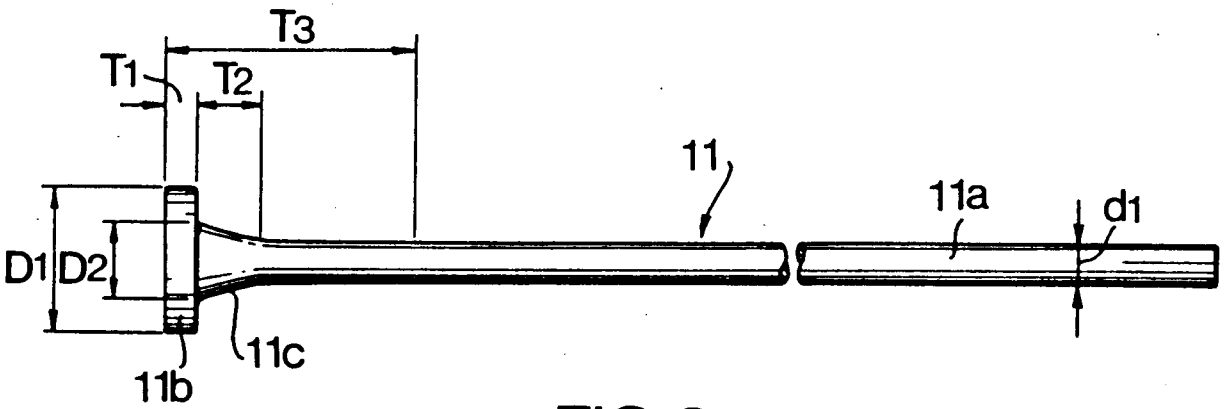
FIG. 3 is a side view of a print needle.

Referring to FIG. 3, the print needle 11 has a tapered portion 11*c* between the needle body 11*a* and head 11*b*.

In a preferable print wire, the diameter D1 of the head, diameter d1 of the body, diameter D2 at the largest portion of the tapered portion 11*c*, and length of the damper portion 11*c* are as follows.

$$D1 \leqq 2d1$$

$$D2 = 1.5 \times d1 \text{ to } D2 = 1.7 \times d1$$

$$T2 = 0.25 \times d1 \sim T2 = 0.31 \times d1$$

Referring to FIG. 1, the electromagnet unit 2 has a cylindrical yoke 21 having a base plate 21*a*. On the base plate 21*a*, a plurality of cores 23 are circularly disposed and secured to the base plate 21*a*. A coil bobbin 25 having a coil 24 is attached to each core 23, so that an electromagnet is formed. On the end of the core 23, a residual 26 having a thickness of 0.04 mm ~0.1 mm is attached.

The armature unit 3 comprises a base 31 secured to the yoke 21, and a plurality of radially arranged armatures 32, each corresponding to the core 23, for impacting the print needles 11. Each armature 32 has a hole at a base end which is engaged with a projection 31*a* formed on the base 31 so as to be pivoted in the axial direction of the core 23. Secured to the armature is a plunger 33 which is inserted into the bobbin 25, corresponding to the residual 26. An armature spring 34 is disposed between the base 31 and a base end of the armature 32 to urge the end to the yoke 21. An actuating end 32*a* of the armature is urged by return spring 16 to a stopper 35 secured to the base 31.

In operation, when the coil 24 is not excited, the armature 32 is biased to the stopper 35 by the armature spring 34 and return spring 16. When the coil is energized, the plunger 33 is attracted to the core 23 and the armature 32 is pivoted about the projection 31*a* against the springs 34 and 16. Thus, the actuating end 32*a* of the armature impacts the impact head 11*b* to push the print needle 11 to a platen (not shown) to print a dot. At that time, the energization of the electromagnet has been cancelled, so that the armature 32 bounds back, pivoting about the projection 31*a* and returned to the rest position by the armature spring 34. The print needle 1 is returned to the rest position by the return spring 16.

Since the return spring 16 has small diameter end 16*a*, the head 11*b* of the print needle 11 can be reduced in diameter to reduce the mass thereof. Thus, the print needle can be produced by the heading process at a low cost. Since the head has a small diameter, the heads of print needles can be disposed on a circle having a small diameter. Thus, the inclination angle of the needle to the axis of the nose 12*a* of the guide body 12 can be reduced, thereby reducing the lateral deflection of the tip end of the needle which occurs during the movement thereof. Accordingly, a print having high quality can be produced.

Because the spring 16 has large diameter end 16*b*, the spring can be easily engaged with the print needle 11, the sliding resistance between the spring and the needle is reduced, and the pressure per a unit area exerted on the rear guide plate 15 reduces, thereby preventing the guide plate from wearing.

It will be noted that the coil spring 16 circumferentially moves around the print needle little by little at every compression and expansion, since the end portion of the spring engages with the guide plate, making an angle with the surface of the plate, which causes a circumferential reaction in the spring. By such a circular movement of the spring, the guide plate is worn. However, the closely wound large diameter end 16*b* acts to prevent the spring from moving in the circular direction. If the large diameter portion 16*b* is firmly engaged with the recess 15*a* of the guide plate, the movement can be perfectly prevented.

As to the print needle, it has been found that if diameter D1 is in excess of 2.5 times diameter d1, the head 11*b* breaks down due to cracking which occurs in the heading process. If the diameter D1 is D1 1.5 d1, the spring engages on the head 11*b*, so that spring force reduces, thereby disabling the printing operation. A preferable range is D1=(1.9~2)d1. The tapered portion 11*c* serves to prevent the neck of the print needle from breaking because of concentrated stress.

In case the heading process takes place after the hardening of the wire, a part of the wire is annealed. It is necessary that the length T3 (FIG. 3) of the annealed part is $$T3 > T1 + T2$$

where T1 is the length of the head.

Preferable hardness of the head 11*b* is 550~635 Hv (Vickers) when the hardness of the basic material is 650~750 Hv. In accordance with experiments, it is preferable that the hardness of the basic material is higher than 600 Hv and the hardness of the head is higher than 430 Hv. It should be noted that the heading process increases the hardness of the head and the tapered portion.

While the invention has been described in conjunction with preferred specific embodiments thereof, it will be understood that this description is intended to illustrate and not limit the scope of the invention, which is defined by the following claims.

What is claimed is:

1. A dot matrix print head comprising:

a print needle unit having a needle guide;

a plurality of print needles, each of which comprises a needle body slidably mounted in the needle guide and a head having a larger diameter than the needle body;

an armature unit having a plurality of armatures, each corresponding to one of the print needles;

an electromagnet unit having electromagnets, each corresponding to the armature for actuating the print needles; and a return coil spring provided between the head of the print needle and a recess formed in the needle guide, wherein the head of the print needle is integrally formed with the needle body by means of a heading process of a wire, and includes a spring receiving portion;

the return coil spring has a small diameter end portion being in engagement with the spring receiving portion of the head and a closely wound large diameter portion having a larger diameter relative to the small diameter end portion and being in engagement with the inside cylindrical wall of the recess of the needle guide so as to prevent the return coil spring from moving in the circular direction thereof, and said return coil spring includes a substantially conical peripheral shape between the small diameter end portion and the large diameter portion for maintaining clearance between said needle body and said return coil spring.

2. The print head according to claim 1 wherein a portion of the return coil spring at each end is closely wound so that two or more windings of the spring come in contact with each other.

3. The print head according to claim 1, wherein the diameter of the head is less than two times the needle body.

4. The print head according to claim 3 wherein the print needle has a tapered portion between the head and the needle body, diameter at large end of the tapered portion is between 1.5 times and 1.7 times the needle body diameter, and length of the tapered portion is between 0.25 times and 0.31 times the needle body diameter.

5. The print head according to claim 1, wherein each of the heads of said plurality of print needles are supported in a small diameter circle thereby reducing an inclination angle of each of said plurality of print needles with respect to a print surface, whereby lateral deflection of a tip end of each of said plurality of print needles is reduced upon actuation of a respective print needle.

* * * * *